US005322428A

United States Patent [19]

Hansen et al.

[11] Patent Number: 5,322,428

[45] Date of Patent: Jun. 21, 1994

[54] GEAR TRANSFER PUMP WITH LUBRICATION AND SEALING OF THE DRIVESHAFT AND IDLER PIN

[75] Inventors: Milton N. Hansen; Steven D. McMahon, both of Mansfield, Ohio

[73] Assignee: The Gorman-Rupp Company, Mansfield, Ohio

[21] Appl. No.: 986,479

[22] Filed: Dec. 7, 1992

[51] Int. Cl.[5] ..... F04C 2/10; F04C 15/00

[52] U.S. Cl. ..... 418/91; 418/104; 418/142; 418/144; 418/169; 418/2

[58] Field of Search ..... 418/2, 91, 104, 142, 418/144, 166-171

[56] References Cited

U.S. PATENT DOCUMENTS

| | | | |
|---|---|---|---|
| 1,645,967 | 10/1927 | Patterson . | |
| 1,706,829 | 3/1929 | Thomson . | |
| 1,709,580 | 4/1929 | Jensen | 418/169 |
| 1,972,565 | 9/1934 | Kempton | 418/169 |
| 2,044,893 | 6/1936 | Wilhelm et al. | 418/169 |
| 2,988,009 | 6/1961 | Kraissl, Jr. . | |
| 3,038,413 | 6/1962 | Emeny et al. | 418/169 |
| 3,198,132 | 8/1965 | Zalis . | |
| 3,198,582 | 8/1965 | Zalis . | |
| 3,272,130 | 9/1966 | Mosbacher . | |
| 3,307,453 | 3/1967 | Nilsson et al. . | |
| 3,364,868 | 1/1968 | Gerber | 418/169 |
| 3,385,514 | 5/1968 | Kilgore et al. . | |
| 4,199,305 | 4/1980 | Pareja | 418/171 |

*Primary Examiner*—John J. Vrablik

*Attorney, Agent, or Firm*—Watts, Hoffmann, Fisher & Heinke Co.

[57] ABSTRACT

An improved rotary, gear within a gear transfer pump, including a pump housing having a circular pumping chamber communicating with a first port and a second port. An externally driven rotor is in meshing relationship with an internal idler gear. To enable the pump to handle an abrasive fluid medium or a non-homogenous pump fluid, an idler gear seal and a shaft seal are employed to contain pumped fluid within the pump chamber. A source of lubricating/flushing fluid is communicated to an idler gear bearing region and a shaft bearing. An idler gear seal includes a "flow resisting" side exposed to pump chamber fluid and a "flow passing" side exposed to lubricating/flushing fluid. The shaft seal includes a "flow resisting" side exposed to pump chamber pressure and a "flow-passing" side exposed to lubricating fluid. A cross-communicating fluid circuit maintains the "flow resisting " sides of both seals at substantially the same pressure. In an alternative embodiment, the flow resisting side of the idler gear seal and the flow resisting side of the shaft seal communicate with intake port pressure. By introducing the lubricating/flushing fluid at a pressure higher than the pressure to which the high-pressure sides of the seals are exposed, fluid leakage across the seal interfaces will occur from the "flow passing" sides to the "flow resisting" sides, thereby flushing the seal interfaces with the lubricating/flushing fluid. The flow of pump chamber fluid across the seal interfaces is substantially resisted.

19 Claims, 3 Drawing Sheets

GEAR TRANSFER PUMP WITH LUBRICATION AND SEALING OF THE DRIVESHAFT AND IDLER PIN

TECHNICAL FIELD

The present invention relates generally to fluid pumps and in particular to an improved "gear Within a gear" type transfer pump which is capable of pumping an abrasive medium.

BACKGROUND ART

Transfer pumps of the "gear within a gear" configuration are used in many applications to pump fluids at relatively high flow rates at relatively low pressures (less than 1000 psi) as compared to hydraulic system pumps which often operate at pressures well in excess of 1000 psi. This type of transfer pump, usually includes an internal crescent positioned between an outer, driven gear (alternately termed a "rotor") and a smaller, idler gear. The outer gear is connected to a shaft that extends through the housing and is attached directly or indirectly to a drive motor. The idler gear rotates about a fixed idler pin and is driven by the outer gear, as distinguished from a "gerotor" type of gear pump in which an "outer gear" includes inwardly directed teeth that mesh with, and are driven by, an internal drive gear.

A gear within a gear type of transfer pump is called upon to perform a wide variety of tasks in a wide variety of environments. In at least some applications, this type of gear transfer pump is used to pump fluids which contain abrasive material or fluids with particles in suspension. In conventional gear pumps, pumping these kinds of fluids often cause premature failure in one or more pump components. Pump constructions have been disclosed in the past which were intended to be used in applications involving fluids containing entrained solids. An example of such a pump is illustrated in U.S. Pat. No. 1,709,580. According to the disclosure in this patent, the illustrated pump is intended to pump pulp in solution such as paper or wood pulp. In the disclosed pump a shearing action is provided for preventing the rolling and jamming of the pulp between the casing and rotor. A flushing arrangement is also used for flushing the bearings of the idler pinion and rotor shaft to keep them free from accumulation of pulp. The pump disclosed in this patent is not believed to be readily adaptable to applications that involve a pumped fluid that contains entrained abrasives.

DISCLOSURE OF THE INVENTION

The present invention provides a new and improved transfer pump capable of pumping an abrasive medium or a fluid with solids in suspension. The gear transfer pump of the present invention includes a pump housing that defines a circular pumping chamber that communicates with first and second ports. A rotor rotatable within the pump chamber includes a plurality of spaced apart teeth extending axially from a skirt. A drive shaft extends axially from the skirt of the rotor and defines a rotational axis about which the rotor is drivingly rotated by a suitable power source. A seal chamber defined by the housing is spaced axially from the pump chamber.

According to the invention, a seal located intermediate the pump chamber and the seal chamber, is operative to resist the flow of fluid from the pump chamber to the seal chamber. An idler gear is located in the pump chamber in meshing engagement with the rotor and is drivingly engaged thereby. An idler gear bearing rotatably supports the idler gear for rotation on an idler pin. Lubricating/flushing fluid is communicated from an external source to the idler gear bearing. A seal associated with the idler gear is operative to resist the flow of fluid from the pump chamber into the idler gear bearing and surrounding region.

According to a feature of the invention, lubricating fluid is communicated to the idler gear bearing by a passage formed at least partially in the idler pin. To further contain the lubricating/flushing fluid, the idler gear defines a blind bore which, in the illustrated embodiment, comprises a throughbore formed in the idler gear that is blocked at one end by a plug. 10 The idler gear seal includes a "flow resisting" side exposed to pump chamber pressure and a "flow passing" side exposed to pressure of the lubricating/flushing fluid communicated to the idler gear bearing by means of the idler pin passage. The "flow resisting" side of the idler gear seal resists the flow of fluid from the pump chamber into the idler gear bearing region to a greater extent than the "flow passing" side resists the flow of lubricating/flushing fluid from the idler gear bearing region to the pump chamber. This is further promoted by maintaining the pressure of the lubricating fluid above the pressure to which the "flow resisting" side of the idler gear seal is exposed. Leakage is designed to occur across the seal interface from the idler gear bearing region into the pump chamber. In this way, the seal interface is continually flushed with clean lubricating/flushing fluid and the ingress of abrasive or non-homogeneous pump fluid from the pump chamber into the bearing region is substantially inhibited. In the preferred and illustrated embodiment, the idler gear seal comprises a lip seal.

The intermediate seal located between the pump chamber and the seal chamber, in the preferred embodiment, is also a lip seal having a "flow resisting" side exposed to fluid in the pump chamber and a "flow passing" side exposed to lubricating/flushing fluid pressure. In the preferred configuration, fluid flow from the pump chamber to the seal chamber is substantially resisted by the "flow resisting" side of the intermediate seal. The flow of lubricating/flushing fluid from the seal chamber into the pump chamber is resisted to a lesser extent so that by maintaining the lubricating/flushing fluid pressure on the "flow passing" side of the intermediate seal at a pressure greater than the pressure to which the "flow resisting" side is exposed, fluid leakage will occur from the seal chamber to the pump chamber. Again, this arrangement assures that the seal interface of the intermediate seal is flushed with lubricating fluid and substantially insures that the abrasive pump medium or non-homogeneous pump fluid in the pump chamber does not flow into the seal chamber.

According to another feature of the invention, the "flow resisting" sides of the idler gear seal and the intermediate seal are maintained at substantially equal pressures. With this feature, a single supply of lubricating/flushing fluid can be used to provide lubricating fluid to both the idler gear bearing and a shaft bearing. In the illustrated embodiment, a conduit cross-communicates regions of the pump which communicate with the "flow resisting" sides of the idler gear and intermediate seals. According to a further feature of the invention, the pressure in the cross-communicating conduit may be monitored by a pressure gauge or other display so that, in use, the pressure of the lubricating/flushing fluid supply can be maintained at a pressure higher than the pressure in the cross-communicating conduit.

According to another preferred embodiment, the flow resisting sides of the idler gear seal and the intermediate seal are both communicated with an intake or suction port of the transfer pump. In this embodiment, fluid pressure at the flow resisting side of the idler gear seal is communicated with the suction port of the transfer pump by a series of passages or openings. In the illustrated construction, a transverse bore defines a passage that communicates with the transfer pump ports via cross passages formed in the head. In the illustrated construction, the flow resisting side of the idler gear seal is communicated with the transverse passage by a slot that extends from a gear contacting surface defined by the pump head and that opens into the transverse bore. Each end of the transverse bore communicates with one of the transfer pump ports. The end of the bore that communicates with the discharge side of the pump is isolated using a plug.

The pump chamber side of the intermediate seal is communicated with the intake port through a passage formed by a series of passages and bores formed in an intermediate housing of the pump. By communicating the flow resisting sides of both the idler gear seal and the intermediate seal with the pump intake port, substantially equal pressures are maintained in both seal regions. By introducing lubricating/flushing fluid at a pressure greater than intake port pressure, a flow of fluid across the seal interfaces occurs from the flow passing sides of the seals to the flow resisting sides.

In the preferred embodiment, lip seals are used for both the idler gear and shaft seals. As is known, lip seals come in several varieties and may include both spring-energized and nonspring-energized lip faces. Seals other than lip seals may be used for either the idler gear seal or shaft seal or both.

Additional features of the invention will become apparent and a fuller understanding obtained by reading the following detailed description made in connection with the accompanying drawings.

BEST MODE FOR CARRYING OUT THE INVENTION

Figure 1:
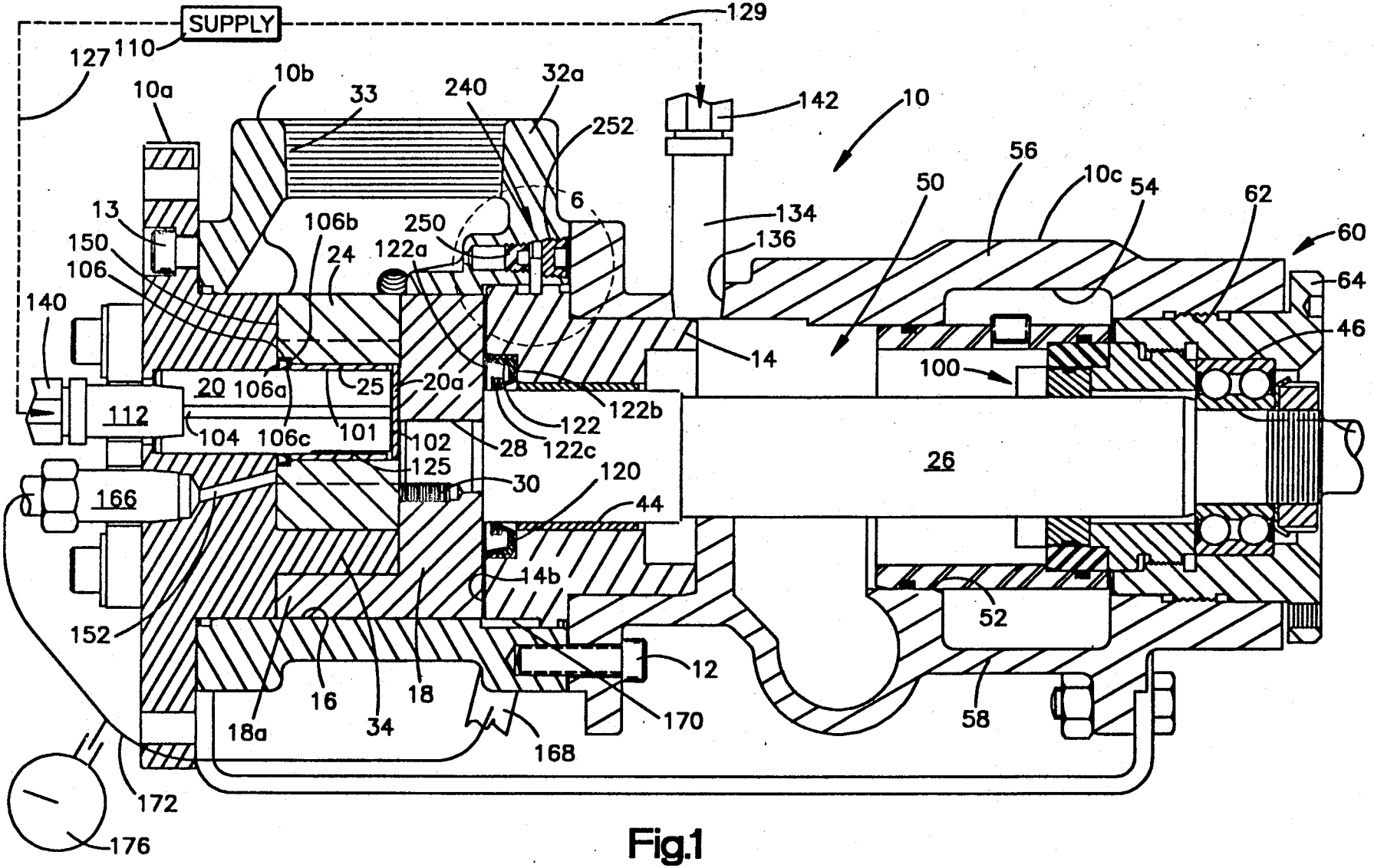
FIG. 1 is a sectional view of a gear within a gear, transfer pump constructed in accordance with one preferred embodiment of the invention.

FIG. 1 illustrates the overall construction of a transfer gear pump embodying the present invention. The gear pump includes a gear casing indicated generally by the reference character 10 which comprises a head **10*a*, a pump housing 10*b* and a backhead 10*c*. The three casing components are bolted together by a plurality of bolts 12, 13. The pump members 10*a*, 10*b* and a sleeve-like pump insert 14 together define a pumping chamber 16. A rotor 18 is rotatable within the pumping chamber 16 and includes a plurality of radially extending teeth 18*a*. The head 10*a* mounts a fixed idler pin 20 which rotatably supports an idler gear 24 that is in meshing relationship with the peripheral teeth 18*a* of the rotor 18. In the illustrated embodiment, the idler gear 24 includes a bushing 25**.

The rotor 18 is driven by an external drive motor (not shown) through a drive shaft 26. The drive shaft 26 extends through the backhead **10*c* and is press fitted into a central bore 28 formed in the rotor 18. A set screw 30 is used to lock the rotor 18 to the shaft 28** to inhibit relative rotation between the members.

The pump (or rotor) housing **10*b* defines ports 32*a*, only one of which is shown in FIG. 1. Each port 32*a* may include a threaded portion 33 by which connections to conduits, etc. can be made. A crescent 34 is integrally formed in the head 10*a* and is positioned between a peripheral portion of the idler gear 24 and an inner peripheral region of the outer rotor 18**.

The shaft 26 is rotatably supported by a bushing 44 pressed fitted into the sleeve-like housing insert 14. An opposite end of the shaft 26 is supported in a conventional, ball bearing assembly 46.

As seen in FIG. 1, the shaft 26 extends through a seal region defined by the backhead **10*c* and indicated generally by the reference character 50. In particular, a cylindrical surface 52 is defined by structure machined internally in the backhead. In the preferred embodiment, the backhead also includes a window 54 which in the illustrated embodiment is rectangular in cross section and extends completely through the backhead. Bridging elements 56, 58, integrally cast in the backhead 10*c*, define the window 54 and interconnect an inner portion of the backhead with an end portion 60. The end portion 60 defines an internally threaded bore 62 which is adapted to threadedly receive a bearing cap 64**.

Additional details of a fluid transfer pump and its operation can also be found in co-pending application Ser. No. 7/673,948 filed Mar. 22, 1991, now U.S. Pat. No. 5,197,869 entitled "Rotary Gear Transfer Pump Having Pressure Balancing, Lubrication, Bearing and Mounting Means", and is hereby incorporated by reference.

As seen in FIG. 1, any fluid in the seal region 50 is contained therein by a seal indicated generally by the reference character 100 which inhibits fluid leakage past the drive shaft 26. The seal 100 is shown for illustrative purposes as a mechanical seal. It should be recognized that other types of seals can be employed. The seal assembly 100 itself does not form part of the present invention. A variety of seals that can be used in the seal region 50 are disclosed and illustrated in co-pending U.S application Ser. No. 07/674,501 filed Mar. 22, 1991, now U.S. Pat. No. 5,180,297, entitled "Fluid Transfer Pump With Shaft Seal Structure ", which is hereby incorporated by reference.

The pump illustrated in FIG. 1 includes features enabling it to pump an abrasive medium or a fluid that contains small entrained solids. Provision is made to contain the pump fluid in certain regions of the pump, preferably the pumping chamber 16 and to inhibit the flow of pumping fluid to sensitive components of the pump such as bearings.

Pumping fluid containment is achieved utilizing seals and an external source of lubricating/flushing fluid. In particular, the idler gear 24, which as indicated above, is rotatably supported on a fixed idler pin 20 by a bearing 25 includes a blind bore 101. In the illustrated embodiment, the blind bore 101 is defined by a throughbore formed in the idler gear 24 and a plug 102 is fixed at one end of the bore 101. As a result, an end face 20*a* of the idler pin is isolated from fluid in the pumping chamber 16.

In the preferred and illustrated embodiment, the idler pin includes an axial passage 104 which opens onto the face 20*a*. In addition, a passage, preferably formed by a flat 125, is formed on the idler pin 20, one end of which communicates with the region defined between the end face 20*a* and the plug 102.

An idler gear seal 106 is carried by the idler gear and sealingly engages the idler pin 20. In operation, the seal 106 inhibits the flow of pump fluid in the pump chamber 16 from coming into contact with the idler gear bearing 25.

A source of lubricating/flushing fluid for the idler gear bearing 25 is provided and is indicated generally by the reference character 110. In particular, a fitting is fixed to the pump head 10*a* and includes a nipple 112 that communicates with the idler pin passage 104. A source of pressurized, lubricating/flushing fluid is delivered via the nipple 112 to the idler pin passage 104.

The flow of pump fluid from the pump chamber 16 into the seal chamber 50 is resisted by an intermediate shaft seal 120 In particular, the insert 14 includes a counterbore 122 in which the seal 120 is mounted. The seal is operative to resist the flow of fluid from the back side of the rotor 18 into contact with the shaft bushing 44 and hence, the seal chamber 50.

The seal chamber 50 also receives lubricating/flushing fluid from the external fluid supply 110. In particular, the supply includes a nipple 134 which communicates with the seal chamber 50 through a bore 136 formed in the back head 10*c*. In the preferred embodiment, the nipple 134 delivers lubricating fluid from the supply 110 to the seal region 50 and provides lubrication and/or cooling for the throttle bearing 44.

In the illustrated embodiment, the idler gear seal 106 and the intermediate seal 122 comprise lip seals. It should be understood, however, that other types of seals such as mechanical seals can be used to provide the necessary sealing between the idler gear 24 and idler pin 20 and between the pump chamber insert 14 and the drive shaft 26.

The use of the disclosed lip seals provides an advantage in the disclosed embodiment and facilitates flushing of the seal interfaces. In particular, the lip seal 122 is arranged so that, what is normally considered to be its "flow resisting" side 122*a* is exposed to pressure in the pump chamber 16. As a result, the seal 122 greatly resists the flow of pump fluid from the pump chamber 16 into the seal region 50.

Similarly, the idler gear lip seal 106 is arranged so that its "flow resisting" side 106*a* is exposed to the pump fluid in the pump chamber 16, and it, too, substantially resists the flow of pump fluid from the pump chamber 16 into the bearing 25 of the idler gear.

The disclosed lip seals provide less of resistance to flow from their "flow passing" sides 122*b*, 106*b* to their high pressure sides 122*a*, 106*a*, respectively. In particular, the flow of lubricating fluid from the seal region 50 across the seal 122 into the pump chamber 16 is resisted to a lesser extent by the lip seal 122 than the flow of pump fluid from the pump chamber 16 to the seal chamber 50. As a result, by supplying lubricating/flushing fluid to the seal region 50 at a pressure greater than the pressure exerted by the pump fluid on the "flow resisting" side 122*a* of the seal 122, the lubricating fluid is made to cross the seal interface indicated generally by the reference character 122*c*, thereby flushing the interface between the sealing lip and the shaft 26, substantially reducing the possibility of having the pump fluid (containing the abrasive material) come into contact with the seal interface or flow into the seal region 50 and damaging the bearing 44.

Similarly, by supplying lubricating/flushing fluid from the supply 110 at a pressure higher than the fluid pressure exerted on the "flow resisting" side 106*a* of the idler gear lip seal 106, lubricating/flushing fluid is caused to flow across the seal interface 106*c* into the pump chamber 16. Again, this flow of lubricating fluid flushes and cools the seal interface (in addition to providing lubrication for the bearing 25) and substantially reduces a risk of abrasive material coming in contact with the seal interface 106*c* and/or the bearing 25.

To further reduce the restriction of flow of lubricating fluid from the idler pin passage 104 to the lip seal interface 106*c*, a channel or flat 125 is formed in the idler pin 20. This flat facilitates the flow of lubricating/flushing fluid to the seal region. Absent this channel, the flow of lubricating/flushing fluid could only occur through the bearing clearance provided between the pin 20 and the bearing 25 which, in operation, would provide a substantial resistance to flow requiring a higher pressure in order to achieve and/or maintain the flow of lubricating/flushing fluid to the seal region. This same resistance to flow occurs in the bearing 44/shaft 26 clearance. This can be improved by supplying a small axial groove in bearing 44 to provide a path for the lubricating fluid as it moves toward the seal 122.

In the preferred embodiment, the rate of flow of lubricating fluid into the idler pin passage 104 and the seal chamber 50 is controlled by flow controllers or restrictors 140, 142 located upstream of the nipples 112, 134, respectively. These flow restrictors act to meter the amount of lubricating/flushing fluid entering the pump. As indicated above, in order to assure the flow of lubricating/flushing fluid across the seal interfaces 106*c*, 122*c* and into the pumping chamber 16, the pressure at which the lubricating fluid is delivered to the pump must be higher than the fluid pressure on the "flow resisting" sides 106*a*, 122*a* of the seals 106, 122. Although separate supplies of lubricating fluid can be used, in the preferred embodiment, the nipples 112, 134 are connected to a common source of pressurized lubricating fluid 110 by conduits 127, 129 (shown schematically).

According to a feature of the invention, a pressure equalizing arrangement is employed to maintain substantially equal pressures on the "flow resisting" sides 106*a*, 122*a* of the lip seals 106, 122. The "flow resisting" side of the idler gear lip seal 106 is exposed to pump chamber fluid that leaks past the idler gear/pump head interface indicated generally by the reference character 150. This is known as "slip" and is due to the necessary internal clearances in the pump. The "flow resisting" side 122*a* of the intermediate seal 122 is exposed to pump chamber fluid that travels to the back side 18*b* of the rotor 18. To maintain substantially equal pressures on the "flow resisting" sides of these seals, an equalizing fluid circuit is provided that maintains a fluid communication between the pump head/idler gear interface 150 and the back side 18*b* of the rotor 18. As seen in the figure, the pump head 10*a* includes a passage 152 which connects the idler gear/pump head interface 150 with a nipple 166. A similar nipple 168 (only a portion of which is shown) extends into fluid communication with the back side 18*b* of the rotor 18. In particular, the insert 14 defines a passage 170 which may be in the form of a flat which, as seen in FIG. 1, communicates at one end with the region defined between the back side of the rotor 18*b* and an end face 14*b* defined by the insert 14. The nipple 168 communicates with the passage 170 through a passage (not shown) formed in the housing 10*b*. A conduit 172 interconnects the nipples 166, 168 and thereby maintains equal fluid pressures in the regions 150, 170. In general, the pressures in the seal regions 122*a* and 20*a* are approximately 50% of the discharge pressure. Therefore, when connected, they are exactly equal and very little flow is induced. A pressure gauge 176 monitors pressure in the equalization conduit 172. In use, the pressure of the supply 110 is adjusted so that it is greater than the pressure in the conduit 172 as displayed by the pressure gauge. As explained above, by operating the lubrication/flushing supply 110 at a pressure higher than the pressure to which the high-pressure sides 106*b*, 122*b* of the seals 106, 122 are exposed, fluid flow across the seal interfaces 106*c*, 122*c* will always be from the "flow passing" side to the "flow resisting" side.

As indicated above, seal configurations other than lip seals can be used for the idler gear seals and shaft seals. Moreover, the seals 106, 122 can be of different configurations. For example, the idler gear seal may be a lip seal whereas the rotor seal may be a mechanical seal. In addition, other variations can be made to the configuration and positioning of the seals. For example, the shaft seal 122 may be replaced by a seal that sealingly contacts the back side 18*b* of the rotor 18 as opposed to the shaft 26.

FIGS. 2-6 illustrates another embodiment of the present invention. For purposes of explanation, parts and components shown in FIGS. 2-6 that are identical to components shown in FIG. 1, will be labeled with identical reference characters. Components that are similar, but differ slightly, will be labeled with the same reference character, followed by an apostrophe.

In the embodiment of FIG. 1, equal fluid pressures are maintained in the regions 150, 170 by placing these regions in fluid communication with each other through a conduit 172. In the embodiment of FIGS. 2-6, the region corresponding to the regions 150, 170 in FIG. 1, are both placed in fluid communication with an intake port.

Figure 2:
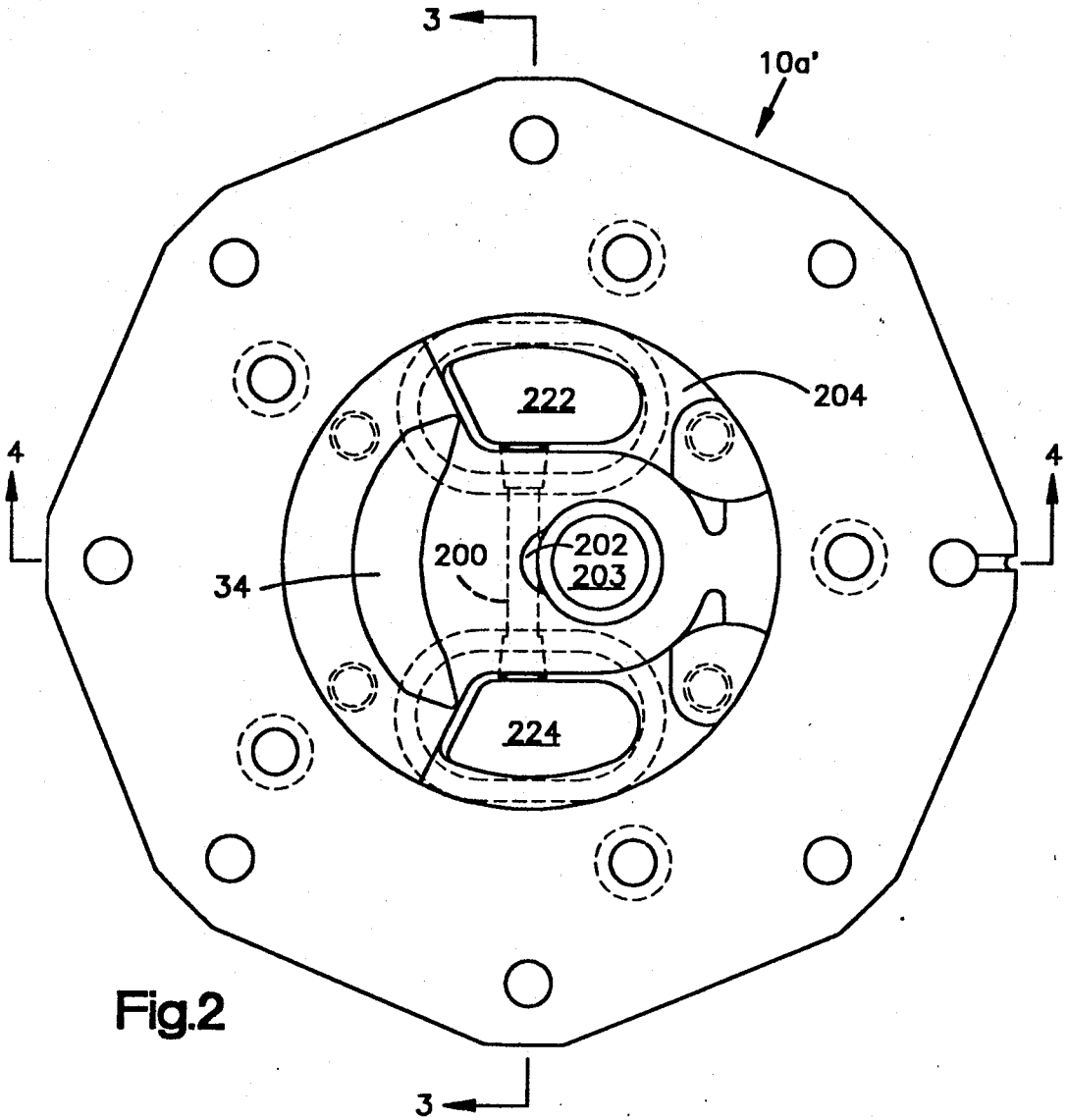
FIG. 2 is an elevational view of a pump head constructed in accordance with another preferred embodiment of the invention.

FIG. 2 illustrates a pump head 10*a*'that includes a fluid passage 200 for communicating the region 150 (shown only in FIG. 1) with an intake port which, in the disclosed embodiment, is determined by the direction of rotation of the rotor 24 (shown in FIG. 1). For purposes of explanation, it will be assumed that the port labeled 32*a* in FIG. 1 is the intake port.

Figure 3:
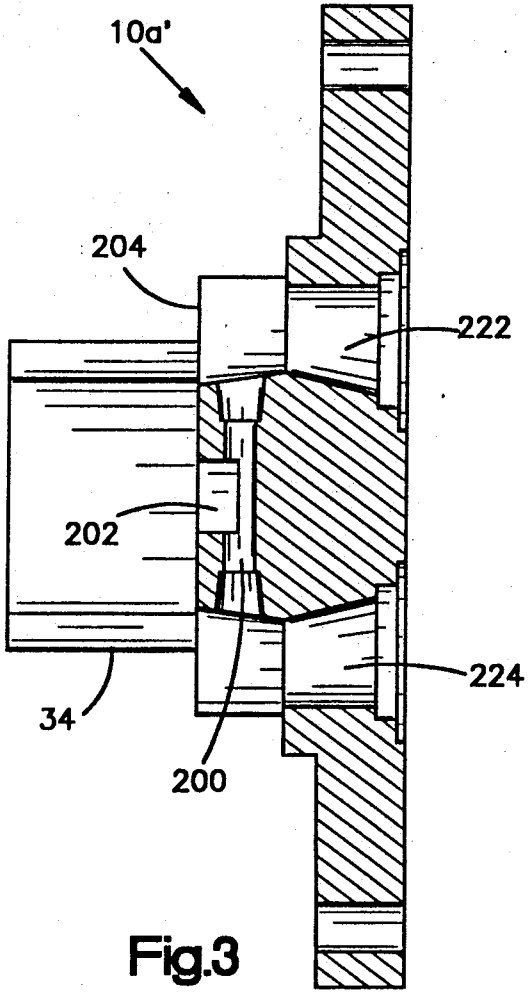
FIG. 3 is a sectional view of the pump head as seen from the plane indicated by the line 3—3 in FIG. 2.
Figure 4:
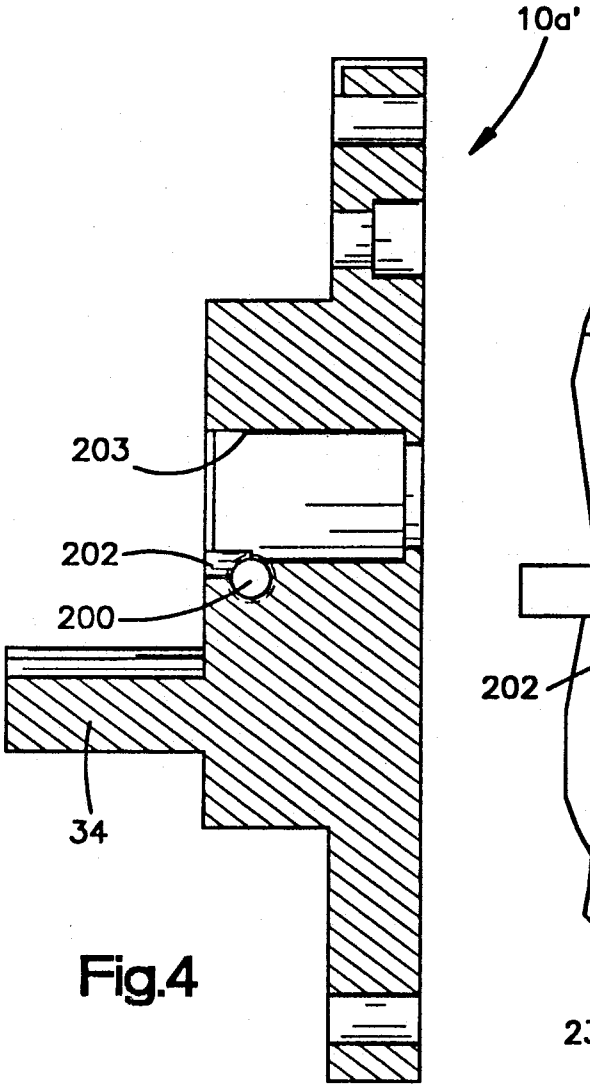
FIG. 4 is another sectional view of the pump head as seen from the plane indicated by the line 4—4 in FIG. 2.

Referring also to FIGS. 3 and 4, the pump head 10*a*-'includes a milled, arcuate slot 202 that extends from a idler gear contact surface 204 to the passage 200. The slot 202 opens into a bore 203, that receives the idler pin 20 (see FIG. 1). As seen in FIG. 1, the region 150 is actually the clearance defined between the idler gear 24 and the gear surface 204 of the head 10*a*'(shown in FIG. 3). As seen in FIG. 3, the passage 200 is adapted to communicate the base of the idler gear (which abuts the surface 204) with either of the pump ports via cross-passages 222, 224. In operation, the passage 200 communicates the base of the idler gear with only one of the ports. In the illustrated embodiment, with the port 32*a* (see FIG. 1) being the intake port, the base of the idler gear is communicated to this port via the passage 200 and the communicating cross-passage 222. The end of the passage 200 that communicates with the cross-passage 224 is blocked by a threaded plug 230, in order to isolate the passage 200 from the discharge port (which communicates with the cross-passage 224). In operation, the flow resisting side 106*a* of the seal 106 (shown in FIG. 1) is maintained at intake port pressure by virtue of the fluid communication established by the slot 202, the drilled passage 200 and the cross-passage 222.

Figure 6:
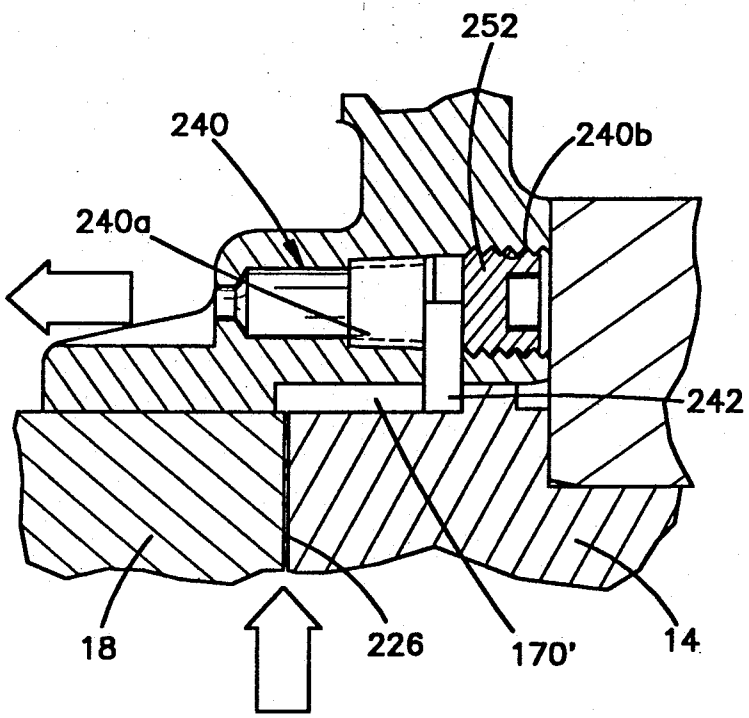
Figure 5:
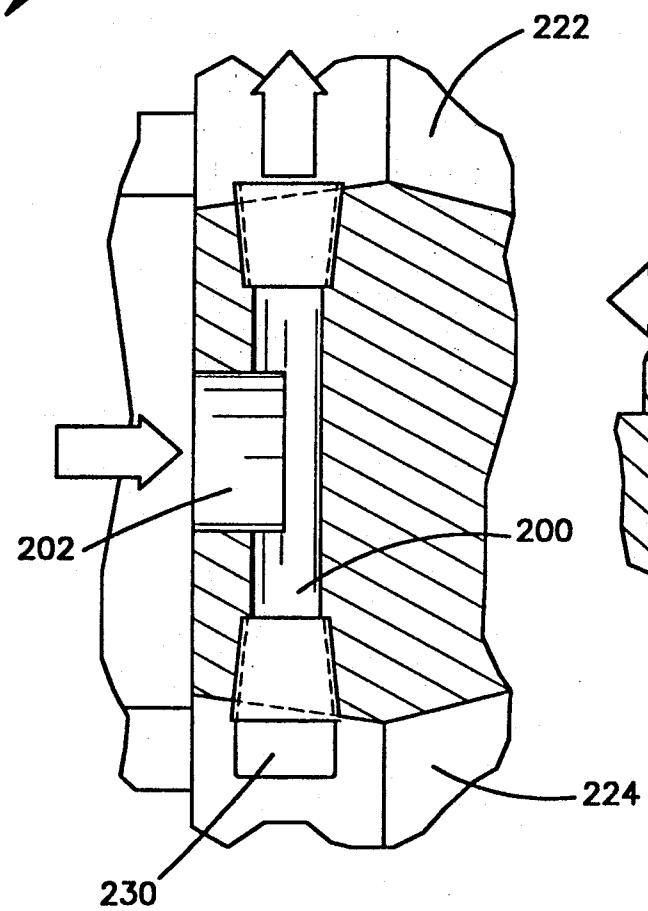
FIG. 5 is an enlarge fragmentary view of a portion of the pump head shown in FIG. 3; and, FIG. 6 is an enlarged fragmentary view of the transfer pump indicated by the circle 6—6 in FIG. 1, with a portion removed.

A region 226 defined between the rotor 18 and the insert 14 (also shown but not labeled in FIG. 1) is communicated to the intake port 32*a* by means of a multi-diameter passage indicated generally by the reference character 240 in FIG. 6, which includes spaced threaded portions 240*a*, 240*b*. An axial passage 170' communicates the region behind the rotor with the multi-diameter passage 240 by means of a radial passage 242. In the embodiment shown in FIG. 1, threaded portions 240*a*, 240*b* of the multi-diameter passage 240, mount threaded plugs 250, 252. In the embodiment of FIGS. 2-6, the threaded plug 250 is omitted to enable fluid communication to the intake port 32*a*. In the embodiment shown in FIGS. 2-6, the region at the base of the idler gear 24 as well as the region 226 defined between the rotor and insert 14, are both maintained at a common pressure, namely intake port pressure.

As long as the lubricating/flushing fluid is injected into the ports 112 and 134 (shown in FIG. 1) at a pressure that is greater than intake port pressure, lubricating/flushing fluid will flow across the seal interfaces 106*c*, 122*c* from the flow passing sides 106*b*, 122*b* to the flow resisting sides 106*c*, 122*c* of the seals 106, 122, respectively.

Although the invention has been described with a certain degree of particularity, it should be understood that those skilled in the art can make various changes to it without departing from the spirit or scope of the invention as hereinafter claimed.

We claim:

1. A rotary, gear transfer pump, comprising:

a) a pump housing defining a circular pumping chamber communicating with a first port and a second port;

b) a rotor rotatable within said chamber including:

i) a plurality of spaced apart teeth extending axially from a skirt portion of said rotor;

ii) a drive shaft extending axially from said skirt portion and defining a rotational axis for said rotor;

c) a seal chamber defined by said housing spaced axially from said pump chamber;

d) an intermediate seal means located intermediate said pump chamber and said seal chamber operative to resist the flow of pumped fluid from said pump chamber to said seal chamber;

e) an idler gear rotatable on an idler pin extending into said pumping chamber and positioned such that said idler gear is in meshing engagement with said rotor and is driven thereby;

f) idler gear bearing means for rotatably supporting said idler gear for rotation on said idler pin;

g) passage means for communicating lubricating fluid to said idler gear bearing means; and h) idler gear seal means associated with said idler gear operative to resist the flow of pumping fluid from said pump chamber to said idler gear bearing means;

i) said idler gear seal means including a flow resisting portion exposed to a pressure related to pump chamber pressure and a flow passing portion exposed to said lubricating fluid;

j) said passage means for communicating said lubricating fluid includes means for maintaining pressure of said lubricating fluid at a pressure that is greater than a fluid pressure exerted on said flow resisting portion of said idler gear seal means.

2. The pump of claim 1 wherein said passage means includes a passage defined by said idler pin that is in fluid communication with said idler gear seal means.

3. The pump of claim 1 further comprising conduit means for maintaining substantially equal fluid pressures on pump chamber sides of said intermediate and idler gear seal means.

4. The pump of claim 1 wherein said first port forms an intake port and said second port forms a discharge port.

5. The pump of claim 4 further including a second passage means for communicating a pump chamber side of said intermediate seal means with said first port.

6. The pump of claim 4 further including a second passage means for communicating a pump chamber side of said idler gear seal means with said first port.

7. The pump of claim 1 wherein:

i) said intermediate seal means includes a flow resisting portion exposed to a fluid pressure related to a pump chamber fluid pressure and a portion exposed to seal chamber pressure; and, ii) said pump further comprises means for communicating lubricating fluid to said flow resisting portion of said intermediate seal means, said passage means for communicating said lubricating fluid, further including means for maintaining a pressure in said seal chamber that is greater than pressure exerted on said flow resisting portion of said intermediate seal means.

8. The pump of claim 7 further including pressure equalizing means for maintaining substantially equal pressures on the flow resisting portions of said idler gear seal means and said intermediate seal means.

9. The pump of claim 8 wherein said equalizing means comprises conduit means for cross communicating said flow resisting portions of said idler gear seal means and said intermediate seal means.

10. The pump of claim 8 wherein said equalizing means comprises conduit means for communicating said flow resisting portions of said idler gear seal means and said intermediate seal means with said first port and wherein said first port comprises a suction port of said pump.

11. A rotary, gear transfer pump, comprising:

a) a pump housing defining a circular pumping chamber communicating with a first port and a second port;

b) a rotor rotatable within said chamber including:

i) a plurality of spaced apart teeth extending axially from a skirt portion of said rotor;

ii) a drive shaft extending axially from a said skirt portion and defining a rotational axis for said rotor;

c) a seal chamber defined by said housing spaced axially from said pump chamber;

d) an intermediate seal located intermediate said pump chamber and seal chamber;

e) an idler gear rotatable on an idler pin extending into said pumping chamber and positioned such that said idler gear is in meshing engagement with said rotor and is driven thereby; and, f) flushing means including passage means communicating fluid under pressure from a source of flushing fluid to a side of said seal exposed to pressure in said seal chamber;

g) said intermediate seal including a flow resisting portion exposed to a fluid pressure related to a pump chamber fluid pressure and a flow passing portion exposed to seal chamber pressure.

12. The pump of claim 11 wherein said intermediate seal comprises a lip seal.

13. The pump of claim 12, further including means for communicating a pump chamber side of said intermediate lip seal with said first port, said first port comprising an intake port.

14. A pump of claim 11 further including an idler gear seal associated with said idler gear and operative to substantially resist the flow of fluid in said pump chamber to a bearing region on said idler gear.

15. The pump of claim 14 wherein said idler gear seal comprises a lip seal.

16. A rotary, gear transfer pump, comprising:

a) a pump housing defining a circular pumping chamber communicating with a first port and a second port;

b) a rotor rotatable within said chamber including:

i) a plurality of spaced apart teeth extending axially from a skirt portion of said rotor;

ii) a drive shaft extending axially from said skirt portion and defining a rotational axis for said rotor;

c) a seal chamber defined by said housing spaced axially from said pump chamber;

d) an idler gear rotatable on an idler pin extending into said pumping chamber and positioned such that said idler gear is in meshing engagement with said rotor and is driven thereby;

e) fluid circuit means for lubricating and cooling said idler pin during pump operation including means communicating fluid from an external source of lubricating fluid to a passage means defined by said idler pin; and, f) idler gear seal means associated with said idler gear operative to resist the flow of pumping fluid from said pump chamber to a bearing region on said idler gear;

i) said idler gear seal means including a flow resisting portion exposed to a pressure related to pump chamber pressure and a flow passing portion exposed to said lubricating fluid;

j) said passage means for communicating said lubricating fluid includes means for maintaining pressure of said lubricating fluid at a pressure that is greater than a fluid pressure exerted on said flow resisting portion of said idler gear seal means.

17. The pump of claim 16 wherein said idler gear seal means comprises a lip seal.

18. A rotary, gear transfer pump, comprising:

a) a pump housing defining a circular pumping chamber communicating with a first port and a second port;

b) a rotor rotatable within said chamber including:

i) a plurality of spaced apart teeth extending axially from a skirt portion of said rotor;

ii) a drive shaft extending axially from said skirt portion and defining a rotational axis for said rotor;

c) a seal chamber defined by said housing spaced axially from said pump chamber;

d) an intermediate seal means located intermediate said pump chamber and said seal chamber operative to resist the flow of pumped fluid from said pump chamber to said seal chamber;

e) an idler gear rotatable on an idler pin extending into said pumping chamber and positioned such that said idler gear is in meshing engagement with said rotor and is driven thereby;

f) idler gear bearing means for rotatably supporting said idler gear for rotation on said idler pin;

g) passage means for communicating lubricating fluid to said idler gear bearing means;

h) idler gear seal means associated with said idler gear operative to resist the flow of pumping fluid from said pump chamber to said idler gear bearing means; and, i) pressure equalizing means for maintaining substantially equal pressures on the flow resisting portions of said idler gear seal means and said intermediate seal means.

19. A rotary, gear transfer pump, comprising:

a) a pump housing defining a circular pumping chamber communicating with a first port and a second port;

b) a rotor rotatable within said chamber including:

i) a plurality of spaced apart teeth extending axially from a skirt portion of said rotor;

ii) a drive shaft extending axially from said skirt portion and defining a rotational axis for said rotor;

c) a seal chamber defined by said housing spaced axially from said pump chamber;

d) an intermediate seal means located intermediate said pump chamber and said seal chamber operative to resist the flow of pumped fluid from said pump chamber to said seal chamber;

e) an idler gear rotatable on an idler pin extending into said pumping chamber and positioned such that said idler gear is in meshing engagement with said rotor and is driven thereby;

f) idler gear bearing means for rotatably supporting said idler gear for rotation on said idler pin;

g) passage means for communicating lubricating fluid to said idler gear bearing means;

h) idler gear seal means associated with said idler gear operative to resist the flow of pumping fluid from said pump chamber to said idler gear bearing means; and, i) pressure equalizing means for maintaining substantially equal pressures on the flow resisting portions of said idler gear seal means and said intermediate seal means;

j) said pressure equalizing means comprising conduit means for cross communicating said flow resisting portions of said idler gear seal means and said intermediate seal means.

* * * * *